United States Patent [19]

Waibel et al.

[11] 4,231,319

[45] Nov. 4, 1980

[54] ELECTROSTATIC COPYING APPARATUS

[75] Inventors: Gottfried Waibel, Rossleithen; Günther Maurischat; Heinz Webersik, both of Munich, all of Fed. Rep. of Germany

[73] Assignee: AGFA-Gevaert, A.G., Leverkusen, Fed. Rep. of Germany

[21] Appl. No.: 893,358

[22] Filed: Apr. 4, 1978

[30] Foreign Application Priority Data

Apr. 9, 1977 [DE] Fed. Rep. of Germany ..... 2715904

[51] Int. Cl.[3] ..... G03G 13/00

[52] U.S. Cl. ..... 118/655; 430/121; 361/212

[58] Field of Search ..... 118/655, 653; 222/415; 430/121; 361/212

[56] References Cited

U.S. PATENT DOCUMENTS

| | | | |
|---|---|---|---|
| 3,662,711 | 5/1972 | Hudson | 118/655 |
| 3,863,602 | 2/1975 | Mueller et al. | 118/655 |
| 3,910,459 | 10/1975 | Bock | 118/655 |

*Primary Examiner*—Dennis E. Talbert, Jr.
*Assistant Examiner*—John L. Goodrow
*Attorney, Agent, or Firm*—Michael J. Striker

[57] ABSTRACT

A cascade-type developing unit for an electrostatic copying apparatus is disclosed. A mixture of toner and carrier particles circulates in the unit and its particles become electrostatically charged due to electrification. An arrangement is provided for limiting the charge of the particles to user-selectable values.

4 Claims, 3 Drawing Figures

ELECTROSTATIC COPYING APPARATUS

BACKGROUND OF THE INVENTION

1. Field of the Invention

The present invention relates to electrostatic copying apparatus in general.

More particularly, the invention relates to improvements in electrostatic copying apparatus wherein a mixture of toner particles and of carrier particles is cascaded over a moving charge-carrier (xerographic) surface, in order to convert electrostatic latent images on this surface into powder images.

Still more specifically, the invention relates to improvements in electrostatic copying apparatus wherein the electrostatic charging of toner-carrier mix occurs as the result of triboelectric effects during circulation of the mix at the developing station.

2. The Prior Art

In the type of electrostatic copying apparatus under discussion, the mixture of toner particles and carrier particles is charged as a result of triboelectric interaction between the particles and the particle-contacting surfaces of apparatus components at the developing station. This results in widely differing interactions which, as a rule, cause the particles of the toner-carrier mix to accumulate a charge that differs from the charge of the overall body of mixture. To insure contrasting development of a latent image, i.e. the transfer of a sufficient quantity of toner particles to the image areas and the absence of such particles on the non-image areas of the charge-carrier surface, the charges must be so controlled that the ratio of the charge constituting the latent image to the charge of the toner particles and of the carrier particles will remain within a very narrow range. As a general rule, the toner particles tend to adhere to non-image areas of the charge-carrier surface, due to the presence of such adhesive forces as e.g. residual charge on non-image areas of the surface.

A proposal for an apparatus offering such control-possibilities has been made in U.S. Pat. No. 3,863,602, granted to Joachim Mueller et al. This apparatus has highly conductive particle-contacting surfaces whose purpose it is to improve the homogeneity (uniformity) of the triboelectric charges imparted to the particles of the toner-carrier mixture. It produces a slight discharge of the triboelectric charges of the particles in the toner-carrier particle mixture, to the point where the overall charge of the mixture is substantially uniform and at or near ground potential. As a result, the mixture of carrier and toner particles has been found to produce very good powder images on the xerographic surfaces, even of their lines and of low-contrast areas. However, the elimination of the outwardly acting residual charges of the mixture, resulting from the triboelectric charging and having a polarity opposite to that of the toner charge, necessarily increases the tendency of the apparatus to form undesired images of background areas having a residual charge potential on the xerographic surface. The patent proposes to counteract this by preventing or interrupting a total discharge of the toner-carrier mixture, in that the mixture is made to contact—during part of its travel path—surfaces which exhibit neutral characteristics with respect to the overall triboelectric charge of the mixture. This, however, permits only a relatively casual selection of the desired charge condition since precision in the selection is not possible.

SUMMARY OF THE INVENTION

Accordingly, it is an object of the present invention to provide an improved electrostatic copying apparatus.

More particularly, it is an object of the invention wherein the charge condition of the toner-carrier mixture can be selected and obtained with precision, as desired and needed to accommodate the operation of the apparatus to particular copying requirements.

Another object is to provide an apparatus of the type under discussion wherein the selection and obtention of a desired charge condition for the toner-carrier mixture is effected in a simple, expeditious and inexpensive manner.

In pursuance of these objects, and of others which will become apparent hereafter, one aspect of the invention resides in an electrostatic copying apparatus which, briefly stated, comprises a receptacle for a supply of intermixed toner and carrier particles, a conveyor for withdrawing intermixed particles from the supply and to cascade the withdrawn particles over latent images in the path whereby the surplus of such particles reenters the receptacle and the particles become electrostatically charged as a result of triboelectrification during circulation in and back into the receptacle, an electrode mounted in the receptacle electrically insulated therefrom and positioned to contact the circulating particles, and means for limiting the electrostatic charge of the particles to a maximum desired value.

By resorting to the present invention the charge which develops in the toner-carrier mixture due to triboelectric charging effects, can be limited to a charge level that is predetermined or preselectable. This makes it possible to take into account—by selecting the requisite charge level—a variety of variables, such as the quality of the document or other original which is to be copied, the characteristics of the toner and of the xerographic surface, and the residual charges which occur on the xerographic surface during operation of the copying apparatus.

According to the invention it is currently preferred to interpose between the supply of the toner-carrier mixture and ground a switching element which is conductive when a certain charge differential obtains, and which can be set for desired limit values. For example, a series of switching elements may be interposed between the supply and ground which individually or jointly become conductive at a voltage differential of between say 100 and 1200 volts. It is particularly advantageous to utilize a sequence of several series-connected switching elements which become conductive at a certain voltage differential. The first one of these elements can then be connected with the supply and a step-switch can be provided which, at theoption of a user, connects selected ones of these elements to ground.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF THE PREFERRED EMBODIMENTS

Figure 1:
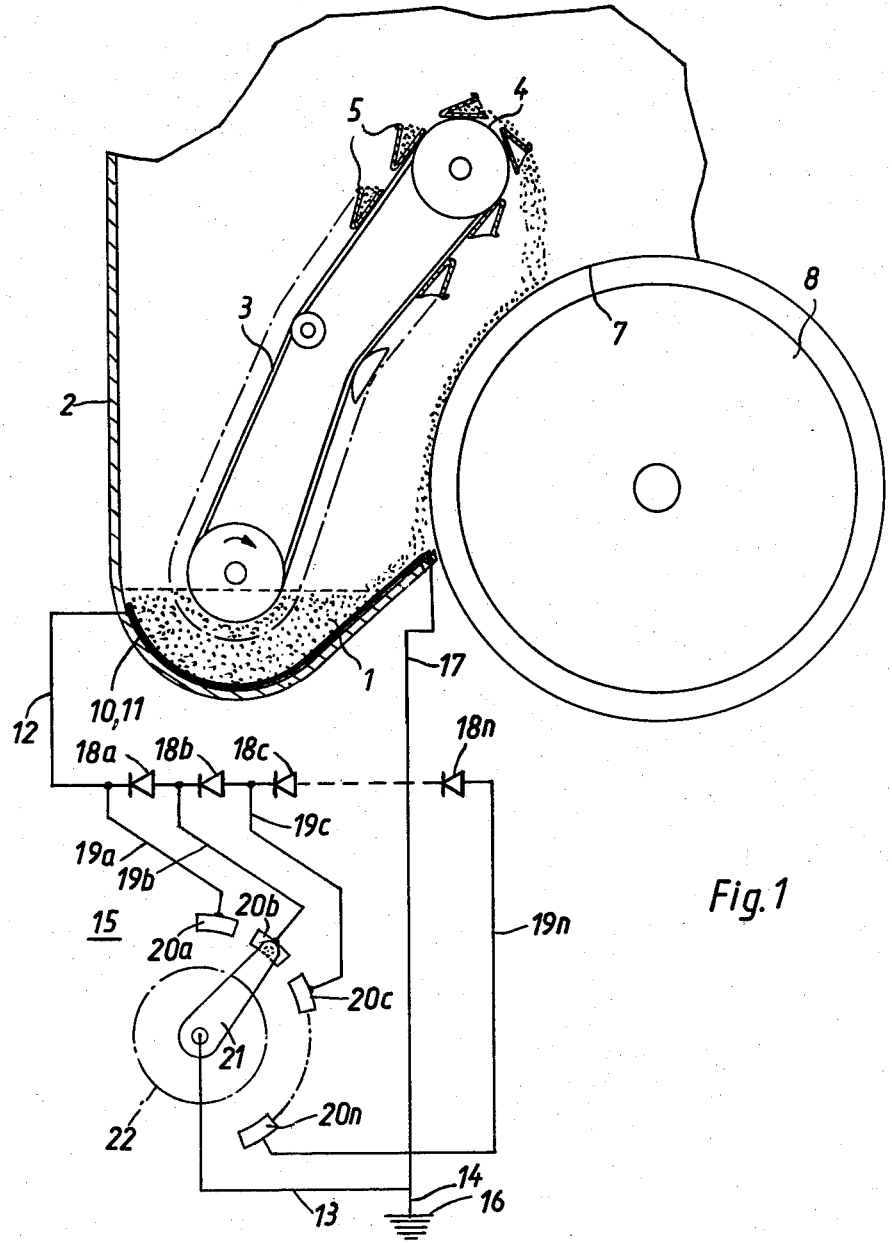
FIG. 1 is a partly sectioned fragmentary view, illustrating an embodiment of the invention.
Figure 2:
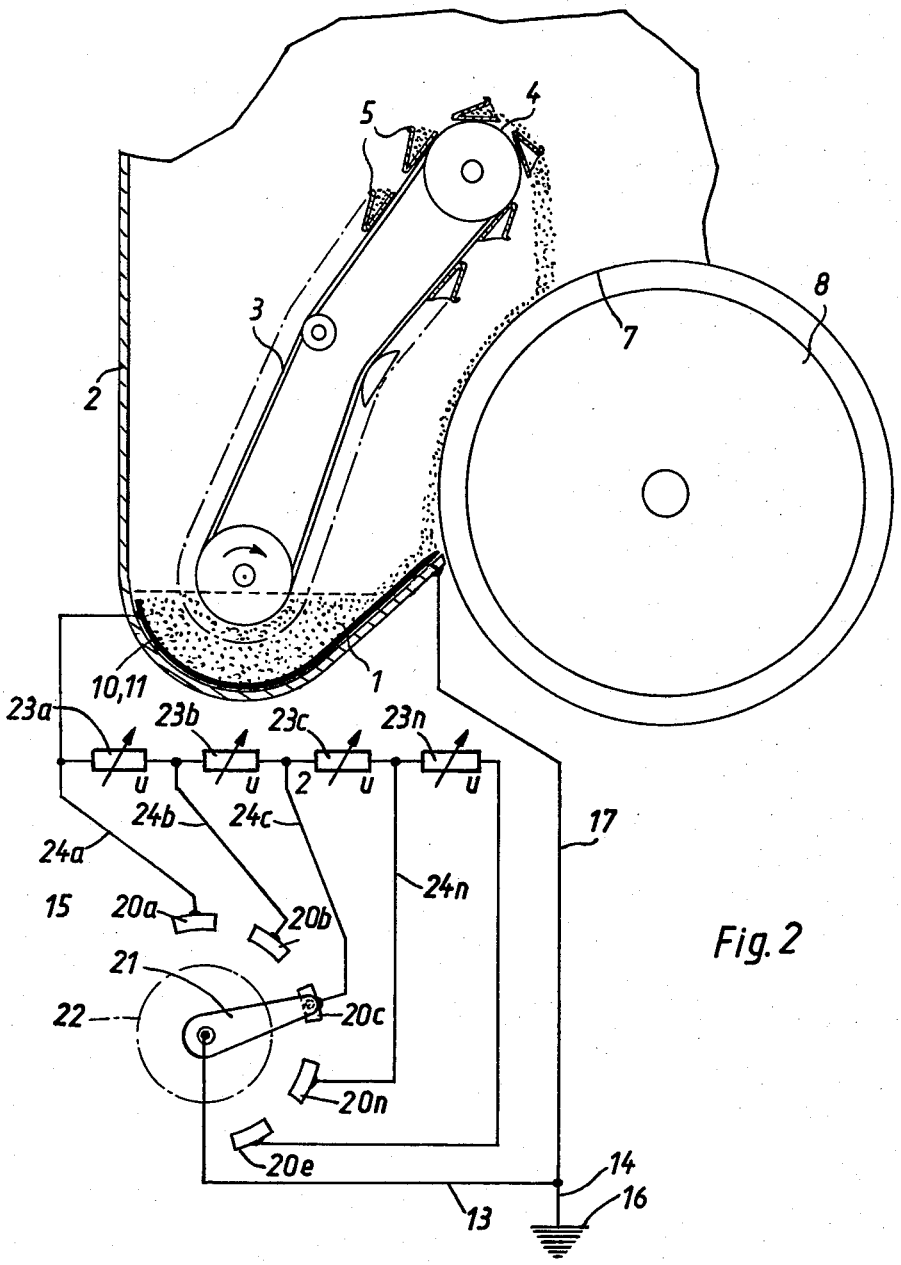
FIG. 2 is a view similar to the one in FIG. 1 but showing a different embodiment.

The FIGS. 1 and 2 show two embodiments of the invention which are identical except for the electrical circuits involved. Like reference numerals have therefore been used to identify like components and the identical aspects will hereafter be described first with reference to both embodiments, to be followed by separate descriptions of the differences between the two embodiments.

With the above in mind it will be seen that FIGS. 1 and 2 both show fragmentary vertical sections through a cascade-type developing station or device of an electrostatic copying apparatus. The station includes a supply receptacle 2 for a mixture 1 of toner particles and carrier particles of the type in which charging of the particles—and of the mixture overall—results from triboelectric effects during relative movement of the particles in the mixture. The composition of the mixture may, e.g. be the same as disclosed in the aforementioned U.S. Pat. No. 3,863,602.

A conveyor is provided, here shown as a bucket-conveyor 3, which transports the mixture to an elevated discharge location 4 at which the buckets discharge their contents to cascade in known manner over the xerographic surface 7 of a charge carrier 8, here shown as a rotary drum. The surface 7 carries a latent electrostatic image to which some of the discharged mixture clings to produce a powder image which is subsequently transferred to an image-carrier, e.g. a sheet of paper. Excess mixture drops into the receptacle 2.

If, as is usual, the image areas of the latent electrostatic image on surface 7 have a positive charge, then a toner-carrier mixture is used wherein the toner particles receive a negative chage due to the triboelectric effect, whereas the carrier particles receive a positive charge. Such a mixture may, for example, be composed of toner particles of synthetic plastic material and carrier particles (e.g. minute spheres) of glass or metal. The negative charges of the toner particles charging to the carrier particles will in part become neutralized due to interaction with the positive charges of the carrier particles, so that a workable mixture may exhibit overall a neutral charge condition. The outwardly acting net charge assumes a zero (neutral) value if grounded electrodes contact the circulating mixture, as in the aforementioned U.S. patent. If the mixture is maintained electrically insulated during its circulation, then it can also develop and outwardly acting (i.e. overall) net charge up to about +2500 volts, due to the triboelectric effects which take place in the circulating mixture.

It has been found that the degree of contrast which can be obtained when making an electrostatic copy, and the degree to which the background areas of the image (e.g. the white areas) remain uncontaminated by charging toner particles, depends to a substantial degree upon the magnitude of the overall net charge of the developer (i.e. toner and carrier particle) mixture. Depending upon the type and quality of the original to be reproduced, and also depending upon the condition of the xerographic surface and residual charges on the same, this net charge may have to vary substantially to obtain the desired degree of contrast and lack of background contamination. This is where the improvements according to the present invention enter the picture.

Figure 3:
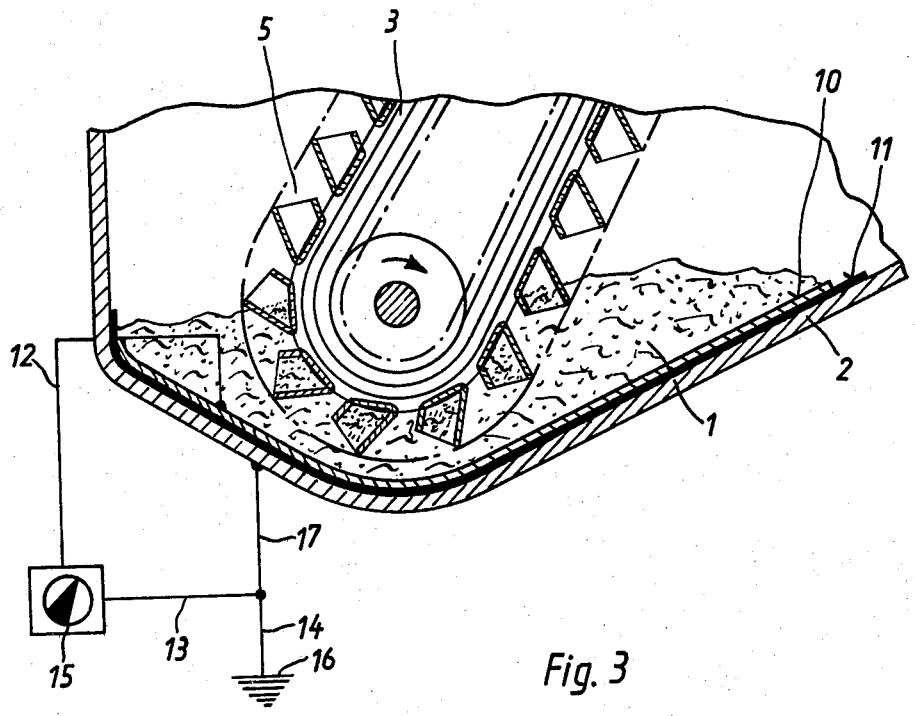
FIG. 3 is an enlarged fragmentary section, showing a detail which is applicable to both of the embodiments in FIGS. 1 and 2.

Both of the embodiments in FIGS. 1 and 2 employ, in the lower part of the receptacle 2, an electrode 10 as illustrated in FIG. 3. This electrode 10, which extends over substantially the entire area in which the developer mixture 1 contacts the electrically conductive housing 2, is insulated from the housing by an insulating layer 11 of any electrically insulating material. The electrode 10 is connected to ground 16 via conductors 12, 13 and 14. To prevent uncontrolled charging of the housing 2 the latter is also connected to ground 16 via a conductor 17.

Interposed between the electrode 10 and ground 16 is a settable, voltage-dependent device 15. This differs in the two embodiments.

In the embodiment of FIG. 1 the device 15 comprises a plurality of Zener diodes 18*a*–18*n*. These are connected by conductors 19*b*–19*n* to individual electrical contacts 20*b*–20*n* of the device 15. A conductor 19*a* directly connects the electrode with an electrical contact 19*a*. A movable contact arm 21 (e.g. a wiper) is turnable by operation of an externally accessible member 22 (e.g. a knob or wheel) to engage the respective contacts 20*a*–20, depending upon its setting; contact arm 21 is connected to ground potential 16 via the conductors 13 and 14. Among the Zener diodes suitable for the device 15 are those available from the German firm Seimens A. G. under the designation BZY 97 C180; these have a voltage drop of about 180 volts between their input and output.

It will be appreciated that, depending upon the position of the contact arm 21, the controlled charge of the developer mixture 1 can be selected to be (i.e. limited to) 0 volts or it can be a to n times the voltage of the Zener diodes; i.e. in the case of the abovementioned Siemens diodes the charge may be 0 volts, 180 volts, 360 volts, 540 volts up to n times 180 volts.

The embodiment of FIG. 2 differs from the one in FIG. 1 in that it utilizes VDR's (Voltage Dependent Resistors) in the device 15, in place of the Zener diodes. These resistors are designated with reference numerals 23*a*–23*n* and may, for example, be of the type which is commercially available from the General Electric Company under the designation Varistor V 250 LA 20A.

The resistors 23*a*–23*n* are connected to the electrical contacts 20*b*–20*n* of the device 15 via conductors 24*b*–24*n*. As before, a movable contact arm 21 is provided which can be turned via the element 22 and is connected to ground 16 by the conductors 13 and 14. Thus, this embodiment also permits a user to produce a controlled discharge of the developer mixture 1 via the electrode 10. This discharge will begin, depending upon the resistor selected with the contact arm 21, at 1 to n times the operating voltage of the individual resistors. If arm 21 engages contact 20*a*, which is directly connected with electrode 10 via conductor 24*a*, then a direct (i.e. non-resistive) discharge of the developer mixture 1 will be obtained.

Depending upon the character and quality of the original being copied, a limitation of the developer mix charge to below 100 volts can already result in appreciable improvement in the background contamination of the copy without leading to any noticeable deterioration in the reproduction of e.g. thin and/or gray lines of the original. In the case of other originals, e.g. those having heavy black lines or a strongly tinted background, it may be necessary to select a resistor (or diode) which becomes effective to permit discharging of the developer mix only shortly before the natural limit of the triboelectrical toner charge is reached, which limit is in the vicinity of about 1500 volts. In the latter potential range the controlled charging of the developer mixture, as disclosed herein, still results in a uniformization of the developer-mix charge due to triboelectric effects (contrary to electrical isolation of the developer mix during part of its circulation). Moreover, even under these conditions the invention will prevent temporary collapse or spill-over of the charges which would lead to the formation of stripes on the background of the copy image.

A further advantage of the invention results from the fact that the net charge required is obtained by controlled limiting of the triboelectric charges which develop in the toner-carrier mixture, rather than by the application of external charges to the mixture. This means that when copying is resumed after an interruption and the residual charges on the xerographic carrier have not yet fully dissipated, the full net charge selected with the contact arm 21 will build up only with a certain delay. In this manner allowance is automatically made—to a certain extent—for the different influence exerted by the residual charges during the start-up period upon the quality of image development.

While the invention has been illustrated and described as embodied in an electrostatic copier, it is not intended to be limited to the details shown, since various modifications and structural changes may be made without departing in any way from the spirit of the present invention.

Without further analysis, the foregoing will so fully reveal the gist of the present invention that others can by applying current knowledge readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. In an electrostatic copying apparatus wherein a travelling xerographic surface is arranged to carry latent electrostatic images in a predetermined path, a developing device for converting said latent images into powder images, comprising a receptacle for a supply of intermixed toner and carrier particles; a conveyor for withdrawing intermixed particles from said supply and to cascade the withdrawn particles over latent images in said path whereby the surplus of such particles reenters said receptacle and the particles become electrostatically charged as a result of triboelectrification during circulation in and back into said receptacle; an electrode mounted in said receptacle electrically insulated therefrom and positioned to contact the circulating particles; and electrically conductive means for limiting the electrostatic charge of said particles to a maximum desired value by connecting said electrode to ground when the electrostatic charge of said particles exceeds said maximum value, said means comprising a plurality of elements each connected between said electrode and ground and each operative to become electrically conductive and to thereby ground said electrode when the electrostatic charge of said particles exceeds one of a plurality of different values which are different for the different elements.

2. A device as defined in claim 1, wherein said elements are Zener diodes.

3. A device as defined in claim 1, wherein said elements are Voltage Dependent Resistors.

4. A device as defined in claim 1, wherein said elements are connected in series and the first one of the series-connected elements is also connected to said electrode; and further comprising step switch means operative to connect selectable ones of said elements to ground.

* * * * *